United States Patent [19]

Kozaiku

[11] Patent Number: 4,952,781

[45] Date of Patent: Aug. 28, 1990

[54] CONTROL OVER SURFACE TEMPERATURE OF A FIXING ROLLER OF A HEAT ROLLER TYPE FIXING DEVICE

[75] Inventor: Kiyoto Kozaiku, Yokohama, Japan

[73] Assignee: Ricoh Company, Ltd., Tokyo, Japan

[21] Appl. No.: 357,605

[22] Filed: May 26, 1989

[30] Foreign Application Priority Data

May 27, 1988 [JP] Japan ..... 63-128272

[51] Int. Cl.[5] ..... G03G 15/20

[52] U.S. Cl. ..... 219/469; 219/216

[58] Field of Search ..... 219/216, 469, 470, 471, 219/497; 355/290

[56] References Cited

U.S. PATENT DOCUMENTS 4,318,612 3/1982 Brannan ..... 219/216

4,415,800 11/1983 Dodge ..... 219/216

4,556,779 12/1985 Hashimoto ..... 219/471

*Primary Examiner*—Teresa J. Walberg

*Attorney, Agent, or Firm*—Oblon, Spivak, McClelland, Maier & Meustadt

[57] ABSTRACT

A method of controlling the surface temperature of a fixing roller of a heat roller type fixing device which is installed in an electrophotographic copier, facsimile apparatus for similar image forming apparatus. When a thermistor which is responsive to the surface temperatures of the fixing roller fails or it is positioned inaccurately relative the roller, the method prevents the surface temperature of the roller from being sensed erroneously and thereby eliminates unusual rises and falls of the surface temperature.

3 Claims, 7 Drawing Sheets

CONTROL OVER SURFACE TEMPERATURE OF A FIXING ROLLER OF A HEAT ROLLER TYPE FIXING DEVICE

BACKGROUND OF THE INVENTION

The present invention generally relates to a heat roller type fixing device for use in an electrophotographic copier, facsimile apparatus or similar image forming equipment and, more particularly, to a method of controlling the surface temperature of a fixing roller which is installed in such a fixing device.

In an image forming equipment of the kind described, a heat roller type or similar fixing device is installed for fixing by fusion a toner image which has been transferred from an image carrier to a paper sheet. A heat roller type fixing device has a fixing roller in which a heating element or heater is built in, a pressing roller held in pressing contact with the fixing roller, and a thermistor pressed against the surface of the fixing roller by a predetermined force to sense the surface temperature of the latter. The heater is turned on and off on the basis of the sensed surface temperature of the fixing roller, whereby the surface temperature is constantly controlled to a predetermined range. However, when the thermistor is pressed against the fixing roller by a less intense force than expected or spaced apart from the roller surface, it is apt to occur that the actual surface temperature of the roller is higher than the predetermined range despite that the thermistor output is indicative of a temperature lying in that range. Such an occurrence may cause a paper sheet to curl more than necessary or, in the worst case, overheat and thereby damage the fixing device. This kind of unusual condition is brought about by a failure of the thermistor element itself also. In any case, it is impossible to maintain the surface temperature of the fixing roller in the predetermined range and therefore to attain a desired fixed image.

SUMMARY OF THE INVENTION

It is therefore an object of the present invention to eliminate the drawback particular to the prior art roller surface temperature control as discussed above.

It is another object of the present invention to provide a roller surface temperature control method which eliminates an unusual rise or fall of the surface temperature of a fixing roller ascribable to a failure of a thermistor itself or an inaccurate position of the thermistor relative to a fixing roller.

It is another object of the present invention to provide a generally improved method of controlling the surface temperature of a fixing roller of a heat roller type fixing device.

A method of controlling surface temperature of a fixing roller of a heat roller type image fixing device such that the surface temperature remains in a predetermined range, the fixing roller having a heater thereinside, comprising the steps of preparing a temperature sensing element held in contact with a surface of the fixing roller for sensing the surface temperature of the fixing roller; sensing the surface temperature by the temperature sensing element; if the temperature sensed by the temperature sensing element when a power source is turned on is lower than a predetermined temperature, sensing the surface temperature again by the temperature sensing element when a predetermined period of time expires after the power source has been turned on; detecting an effective value of a power source voltage when the power source is turned on; comparing an amount of temperature elevation occurred during an interval between the turn-on of the power supply and the expiration of the predetermined period of time with an upper limit and a lower limit of temperature elevation for the interval which are associated with the power source voltage; and when the amount of temperature elevation does not lie between the upper limit and the lower limit which are stored beforehand, determining that the surface temperature is not normal and inhibiting the heater installed in the fixing roller from being driven.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
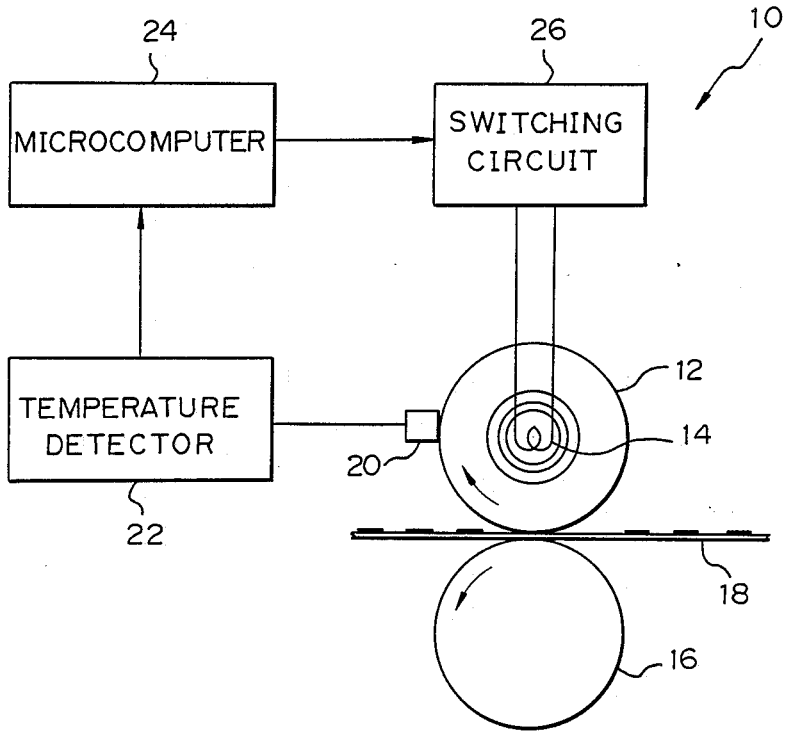
FIG. 1 is a schematic view showing a prior art hat roller type fixing device.

To better understand the present invention, a brief reference will be made to a prior art heat roller type fixing device applicable to an electrophotographic copier or similar image forming equipment, shown in FIG. 1. The prior art fixing device, generally 10, has a fixing roller 12 in which a heating element or heater 14 is disposed to serve as a heat source, and a pressing roller 16 held in pressing contact with the fixing roller 12. A paper sheet to which a toner image has been transferred from a photoconductive element, or image carrier, is passed through between the two rollers 12 and 16 so that the toner image is fixed on the paper sheet by fusion. A thermistor 20 is pressed against the surface of the fixing roller 12 by a predetermined force for sensing the surface temperature of the latter. The output of the thermistor 20 is coupled to a temperature detector 22 the output of which in turn is connected to a microcomputer 24. The microcomputer 24 determines whether or not the surface temperature sensed by the thermistor 20 lies in a predetermined range. When the sensed temperature is lower than the lower limit of the predetermined range, the microcomputer 24 operates a switching circuit 26 to turn on the heater 14. Conversely, when the sensed temperature is higher than the upper limit of the same range, the microcomputer 14 turns off the heater 14 via the switching circuit 26. In this manner, the surface temperature of the fixing roller 12 is controlled to the predetermined range.

However, when the termistor 20 itself is defective or when it is pressed against the fixing roller 12 by a less intense force than expected or spaced apart from the roller surface, it is apt to occur that the actual surface temperature of the roller 12 is higher than the predetermined range despite that the thermistor output is indicative of a temperature lying in that range, as discussed earlier. Such an occurrence may cause a paper sheet to curl more than necessary or, in the worst case, overheat and thereby damage the fixing device.

Figure 2A:
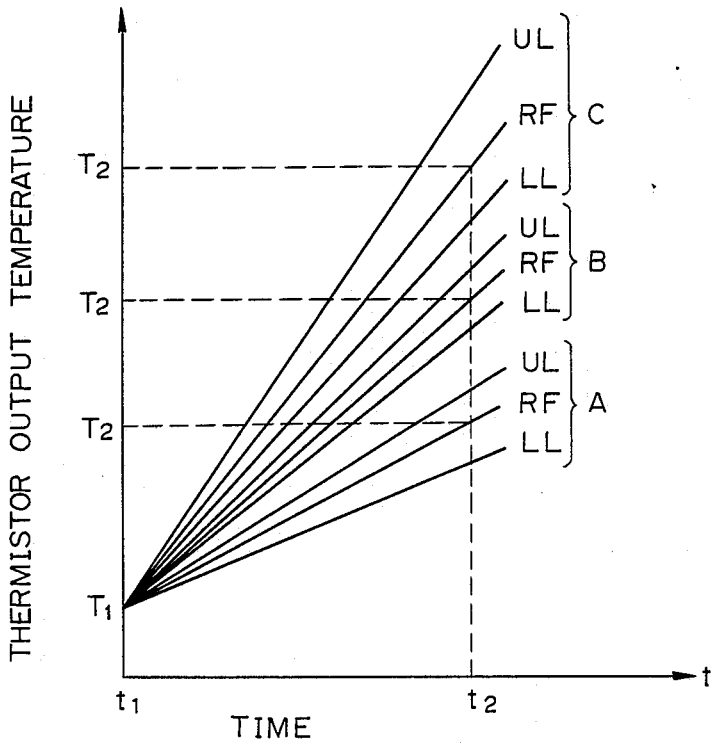
FIGS. 2A and 2B plots a relationship between a power source voltage and a temperature variation rate on which a control method of the present invention is based.
Figure 2B:
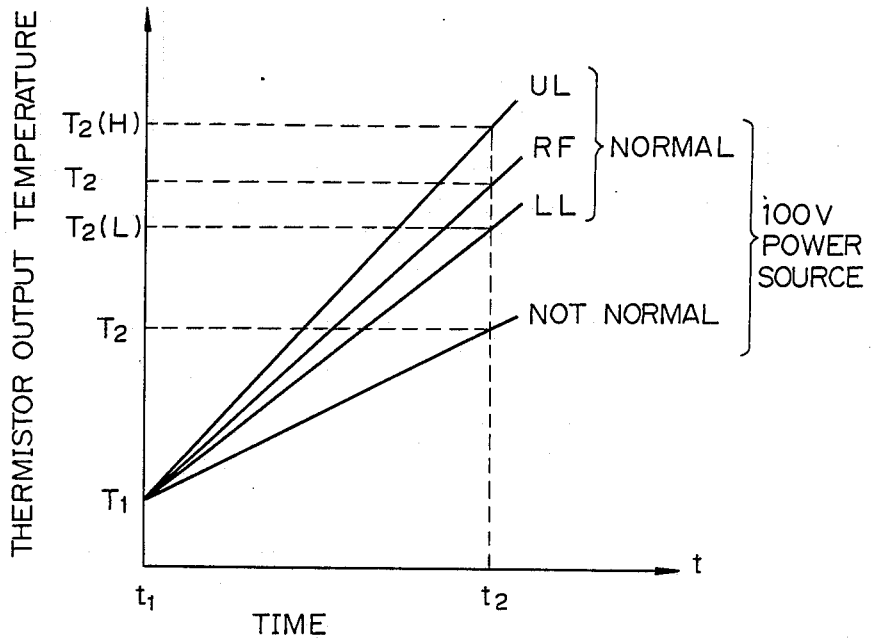

In practice, the voltage of a commercially available power source used to drive a fixing roller varies over a wide range depending upon geometrical area, e.g. AC 80 volts to AC 120 volts. It follows that the surface temperature elevation of a fixing roller occurring when the same image forming apparatus, i.e., the same fixing roller is driven for a predetermined period of time depends on the area. FIG. 2A indicates specific cases A, B and C which are associated with power source voltages of 80 volts, 100 volts and 120 volts, respectively. Specifically, curves RF, UL, LL in each of the cases A, B and C are respectively representative of typical temperature represented by an output of a thermistor, an upper limit, and a lower limit, respectively, with respect to the lapse of time as counted from a time $t_1$ when the power source is turned on. When use is made of a fixing roller in which a heater having a capacity of 1 kilowatt is built in, the surface temperature of the fixing roller has an upper limit and a lower limit during the interval between the times $t_1$ and $t_2$ in association with various power source voltages, as shown in Table 1 below.

TABLE 1

| SOURCE VOLTAGE | TEMP ELEVATION RATE UPPER LIMIT UL (°C.) | LOWER LIMIT LL (°C.) |
|---|---|---|
| 80~85 | 47 | 36 |
| 86~90 | 49 | 39 |
| 95~100 | 54 | 42 |
| 101~105 | 57 | 46 |
| 106~110 | 59 | 49 |
| 111~115 | 62 | 51 |
| 116~120 | 64 | 54 |

The upper and lower limits of temperature elevation associated with the individual power source voltages as listed in Table 1 are stored in a memory beforehand.

Temperatures $T_1$ and $T_2$ sensed by the thermistor at the time $t_1$ when the power source is turned on and the time $t_2$ which is 50 seconds later than the time $t_1$, respectively, and the effective value of the source voltage are sensed. A difference between the sensed temperatures $T_2$ and $T_1$, i.e., $T_2-T_1$ is compared with the stored upper limit and lower limit of temperature elevation which is associated with the power source. The upper and lower limits mentioned above are produced by $T_2(H)-T_1$ and $T_2(L)-T_1$, respectively. If the actual difference between the sensed temperatures $T_1$ and $T_2$ lies between the upper and lower limits, the surface temperature of the fixing roller is determined to be normal. If otherwise, the surface temperature is regarded as being not normal. It is important to note that such error detection is executed only when the temperature sensed on the turn-on of the power source is lower than a predetermined temperature Ts' which is lower than a set temperature Ts of the heater. The temperature Ts' is preselected to satisfy a relationship $$Ts-Ts'>T_2-T_1.$$

Should the temperature $T_1$ sensed on the turn-on of the power source be higher than the predetermined temperature Ts', the surface temperature would be heated to the temperature Ts during the interval between the times $t_1$ and $t_2$, i.e., while the error detection is under way, resulting in the heating element being turned off.

Figure 3:
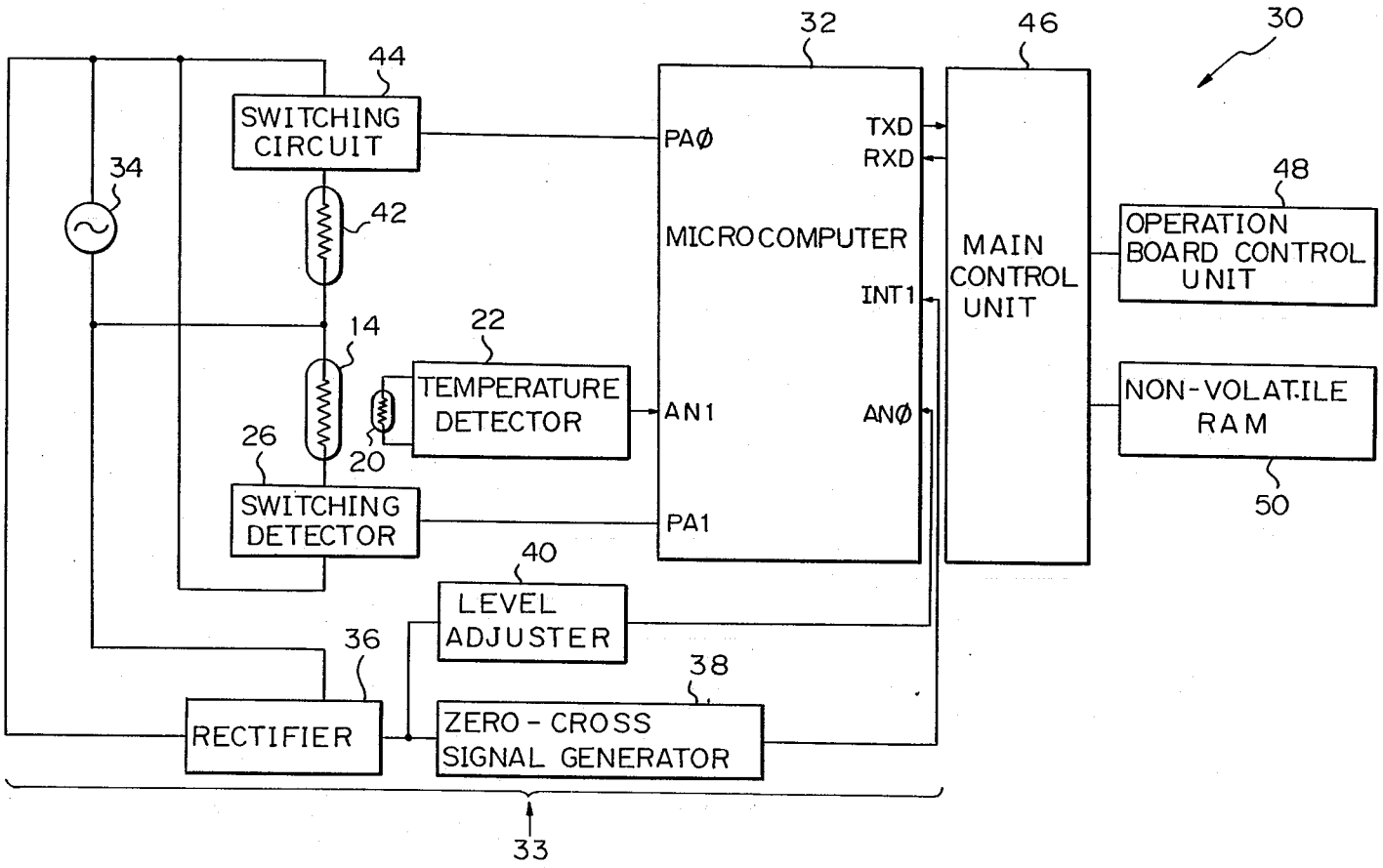
FIG. 3 is a schematic block diagram of a control circuit for practicing the method of the present invention.

Referring to FIG. 3, a control circuit for practicing the method of the present invention is shown which is applied to the fixing device of FIG. 1 by way of example. In the figure, the control circuit, generally 30, not only controls the temperature of the heater 14 and therefore that of the fixing roller 12 but also controls the turn-on and turn-off of a lamp which is adapted for imagewise exposure. The control circuit 30 has a microcomputer 32 and various input and output circuits which are individually connected to input and output ports of the microcomputer 32. The microcomputer 32 is implemented as an 8-bit single-chip computer and has an 8-bit CPU (Central Processing Unit), a ROM (Read Only Memory), a RAM (Random Access Memory), an analog-to-digital (AD) converter, a timer, a serial interface, an I/O (Input/Output) port, etc.

The microcomputer 32 has a terminal INT1 to which a zero-cross signal is applied. The zero-cross signal has a high level or "H" at a zero-crossing timing of an AC waveform of a commercially available power source 34. When an edge signal representative of a positive-going edge is applied to the terminal INT1, an interruption occurs. The power source 34 is insulated, lowered and full-wave rectified by a rectifier 36 so that the zero-cross signal being generated by a zero-cross signal generator 38 becomes "H" at a zero-crossing timing. The microcomputer 32 has a terminal AN0 (AD converter terminal) to which a level adjuster 140 is connected. Specifically, the level adjuster 140 adjusts the above-mentioned full-wave rectified waveform with respect to level and delivers the resulting signal to the terminal AN0 of the microcomputer 32. The microcomputer 32 further has a terminal AN1 (AD converter terminal) which receives a surface temperature of the fixing roller 12 sensed by the termistor 20, by way of the temperature detector 22.

The microcomputer 32 has a terminal PA0 which is an output port allocated to a trigger signal for energizing a lamp 42 which is adapted for imagewise exposure. When the terminal PA0 turns from "H" to a low level or "L", a switching circuit 44 is operated to turn on the lamp 42. The microcomputer 32 has a terminal PA1 which is also an output port allocated to a trigger signal for energizing the heat source of the heater 14. On the change of the terminal PA1 from "H" to "L", the switching circuit 44 is caused to energize the heater 14. Further, the microcomputer 32 has serial interface terminals TXD and RXD for interchanging data with a main control unit 46.

Various control units (not shown) which implement a copying process are connected to the main control unit 46 together with the control unit 33, which includes the microcomputer 32. Also mounted on the main control unit 46 are an operation board control unit 48 which reads key inputs entered on an operation board and controls a display provided on the operation board, and a non-volatile RAM 50 for storing data associated with a copying process, error signals, etc.

Figure 5:
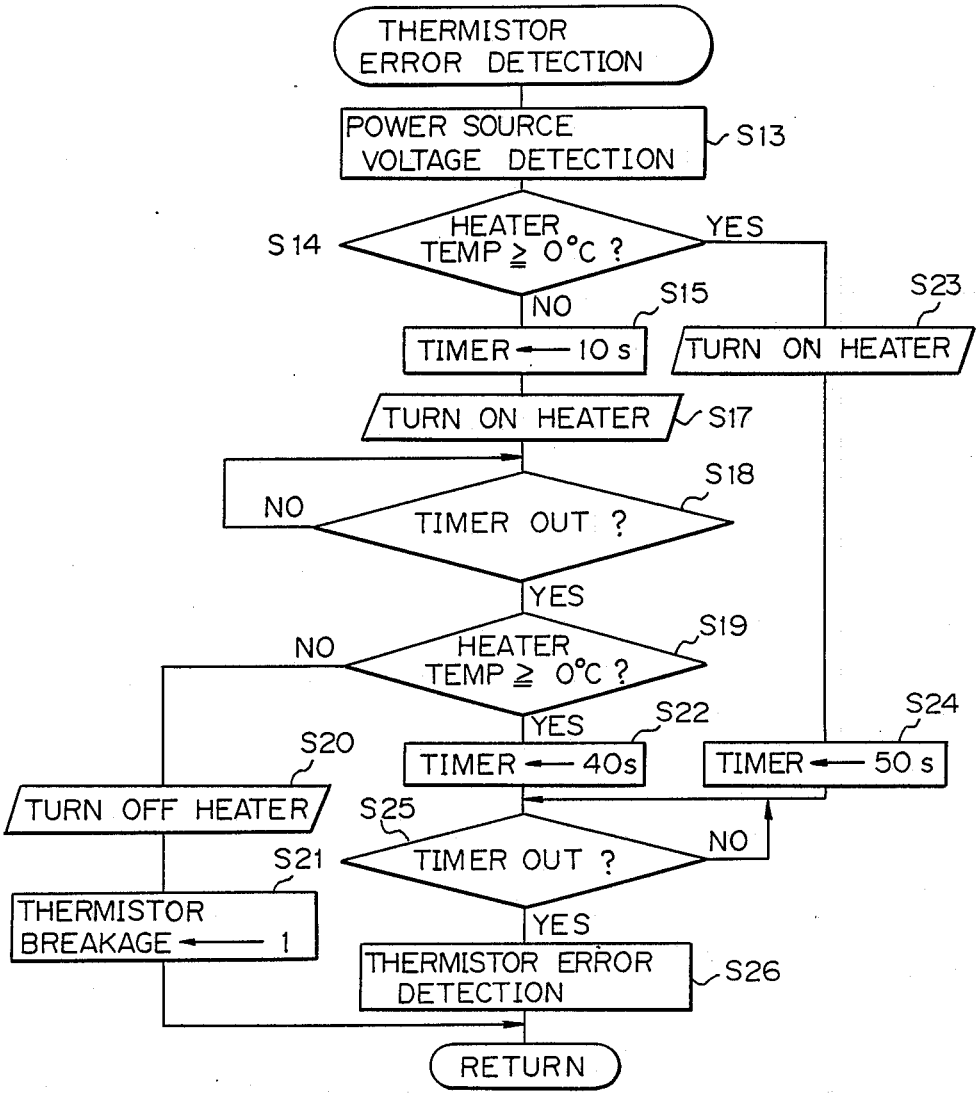
Figure 6:
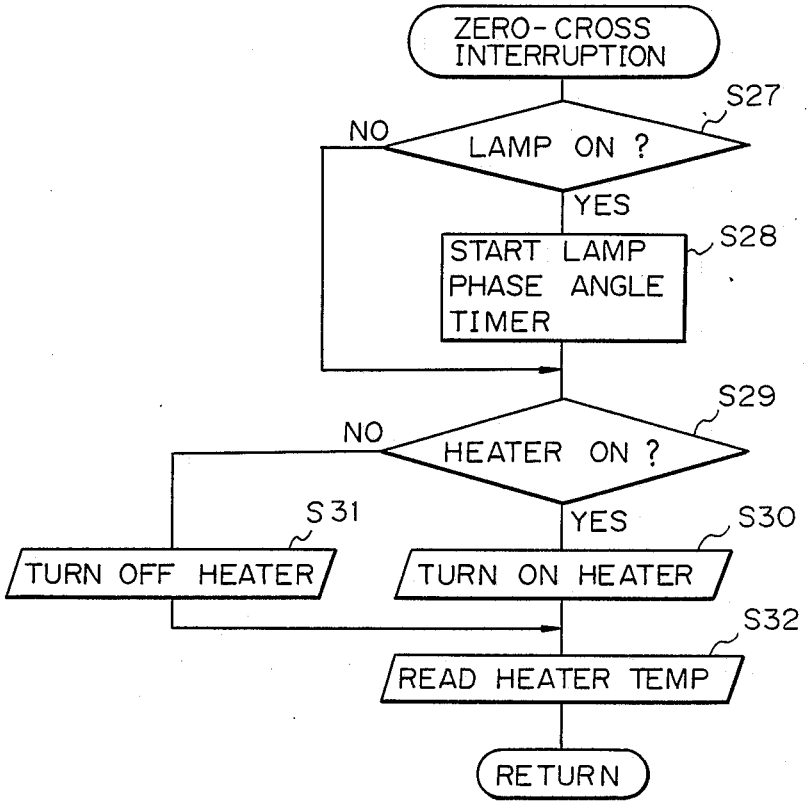

The operations of the control circuit 30 will be described with reference to FIGS. 4, 5 and 6. Specifically, FIGS. 4, 5 and 6 show respectively a main flow, a thermistor error detection routine, and an interrupt flow which is executed in synchronism with a positive-going edge of the zero-cross signal.

Figure 4:
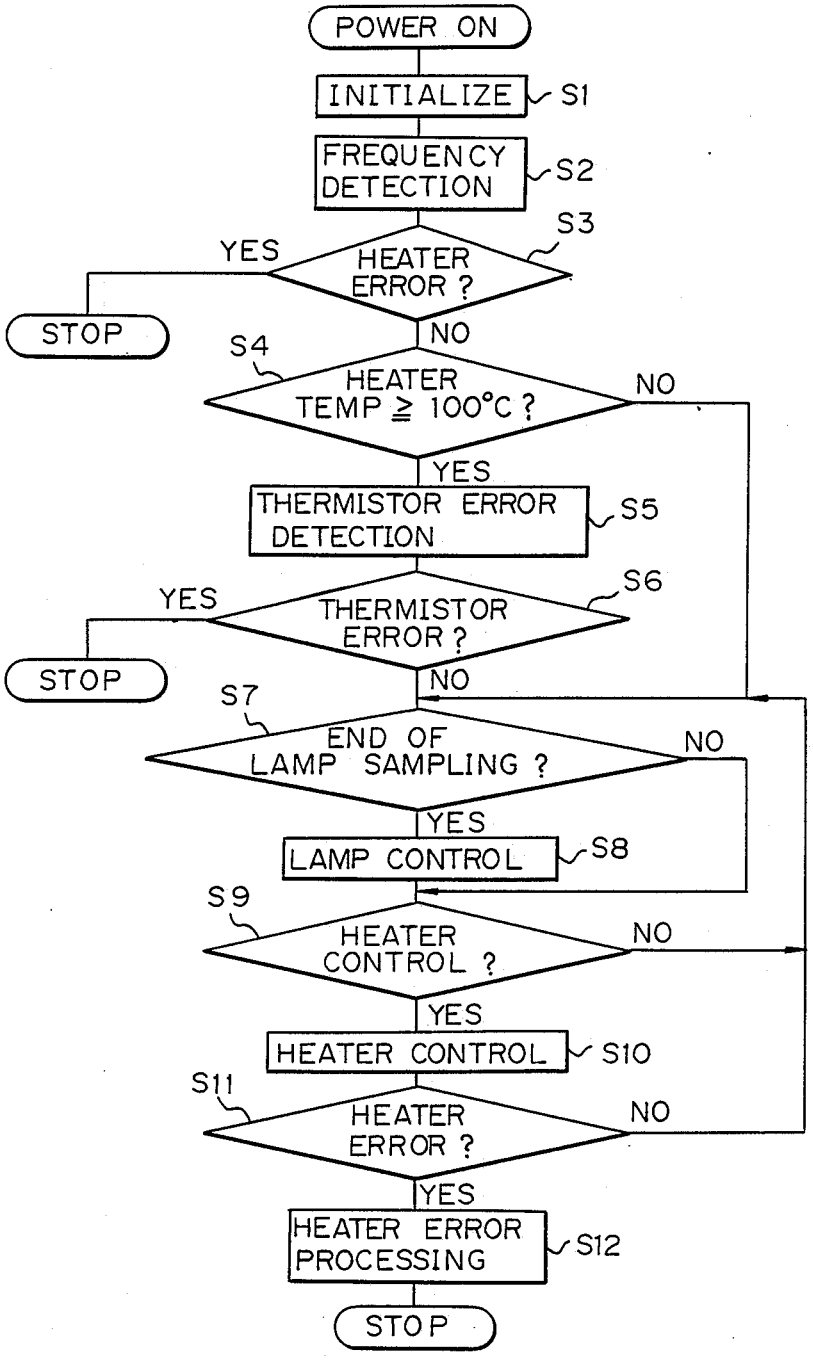
FIGS. 4 to 6 are flowcharts demonstrating specific operations of the control circuit shown in FIG. 3.

As shown in FIG. 4, when the power source is turned on, the system is initialized (step S1), i.e., various ports are set, the RAM is cleared, an interruption is cleared, etc. At this instant, however, a receive interruption alone is accepted. The initializing flow is known in the art, and redundant description will be avoided for simplicity. The step S1 is followed by a step S2 for detecting the frequency of the commercially available power source which is assumed to be either 50 hertz or 60 hertz for illustrative purpose. Specifically, a 0.1 second timer is started in response to a positive-going edge of the zero-cross signal. When 0.1 second expires, another positive-going edge of the zero-cross signal is detected and, then, a 0.5 second timer is started. Positive-going edges of the zero-cross signal which appear before 0.5 second expires are counted. If more than fifty positive-going edges have been detected during such a period of time, the frequency of the power source is determined to be 60 hertz; if the number of positive-going edges counted is 50 or less, the frequency is determined to be 50 hertz.

Subsequently, whether or not an error has occurred in the heater 14 is determined (S3). Specifically, when the heater 14 was determined to be not normal by the last thermistor error detection routine (S5) and heater error detection routine (11), a heater error signal is fed to the main control unit 46. In response, the main control unit 46 stores the input signal in the non-volatile RAM 50 and, at the same time, turns off the heater 14 by operating a power relay (not shown) which is connected in series with the AC power source. Further, the main control unit 46 delivers a heater error signal to the operation board control unit 48, causing the latter to display the occurrence of an error in the heating element 14. To cancel the heating element error signal, keys (not shown) provided on the operation board control unit 48 are manipulated to enter a particular code. The resulting cancel data is fed to the main control unit 46 so as to clear the non-volatile RAM 50. Then, when the power source is turned off and turned on again, the main control unit 46 checks the RAM 50 for the heater error signal. If the heater error signal in the RAM 50 has been cleared by the above procedure, the main control unit 46 sends a heater no error signal to the control unit 33. If the signal in the RAM 50 has not been cleared, the main control unit 46 sends another heater error signal to the operation board control unit 48. The cancellation of a heater error may alternatively be implemented by a dip switch or similar switch which is provided on the operation board control unit 48.

The heater error signal from the main control unit 46 is checked and, if the error has not been removed, the operation is stopped there. If the heater is freed from the error, the instantaneous heater temperature TMP1 is read and stored. Then, whether the temperature TMP1 is 100° C. or not is determined (S4). If the temperature TMP1 is lower than 100° C., the thermistor error detection routine (S5) is performed. This routine will be described in detail with reference to FIG. 5.

In FIG. 5, the thermistor error detection routine begins with a step S13 for determining the effective value VLT of the power source voltage. Specifically, analog-to-digital conversion of the power source voltage being applied to the terminal AN0 of the microcomputer 32 is started in response to a positive-going edge of the zero-cross signal and ended in response to the next positive-going edge of the same. By using the resulting digital data (SMP1, SMP2, . . . , SAMPn), the effective value VLT of the power source voltage is calculated as follows:

$$VLT = \sqrt{(SMP1)^2 + (SMP2)^2 + \ldots + (SMPn)^2/n} \qquad \text{Eq. (1)}$$

Subsequently, the heater temperature TMP1 is checked (S14). If the heater temperature TMP1 is equal to or higher than 0° C., a heater trigger is turned on (S23) while a 50 seconds timer is started (S24). If the temperature TMP1 is lower than 0° C., a 10 seconds timer is started (S15) and the heater trigger is turned on. As soon as 10 seconds expires (S15), the heater temperature TMP2 is read and stored. Whether the heater temperature TMP2 is equal to or higher than 0° C. is determined (S19). If the answer of the step S19 is YES, a 40 seconds timer is started (S22) while, if it is NO, the heater trigger is turned off (S20) and a thermistor breakage signal is set.

The program then waits until the time of the timer started in the step S22 or S24 expires (S25). On the lapse of the time, a thermistor error decision subroutine (S26) is executed. This subroutine begins with storing the instantaneous heater temperature TMP3 sensed at the time of the expiration of the above-mentioned time. Subsequently, the upper and lower limits of the variation rate (amount of variation per unit time) associated with the power source voltage VLT as detected in the step S13 are read out of a table which is stored in the memory (see Table 1). If a difference between the temperatures TMP1 and TMP3, i.e., TMP3 - TEMP1 does not lie between the upper and lower limits read out of the table, a thermistor error signal is set. If otherwise, the thermistor is determined to be normal.

On the completion of the thermistor error detection (S5), whether the thermistor has failed or not is determined (S6). If the answer of the step S6 is YES, an error signal is sent to the main control unit 46 to stop the operation of the device. If it is NO, meaning that the thermistor is normal, lamp control (S8) and heater control (9) are executed. The lamp control does not form an essential part of the present invention, and details thereof will not be described. For the heater control, the duty is updated every 1 second. Whether or not a heater control timing, i.e., a heater duty updating timing has been reached is determined (S9). If such a timing has been reached, the duty of the heater FUCYC is updated by using an equation:

$$FUCYC = FUCYC + KP\{TN1 - TN0\} + KI\{ST - TN0\} \qquad \text{Eq. (2)}$$

where KP and KI are constants which are determined by the characteristic of the heater 14, ST is a set-heater temperature, and TN0 and TN1 are respectively the current heater temperature and the heater temperature detected 1 second before, respectively. Finally, a heater error detection routine is performed. This routine begins with determining if the current heater temperature TN0 is higher than 230° C. and, if it is higher than 230° C., the program determines that the heater 14 has been overheated. Further, whether or not the thermistor 20 has been broken is determined, as stated in relation to the step S5. If the heater 14 is not normal as determined by such heater error checking (S11), heater error processing (S12) is executed to turn off the heater trigger and transmit a heater error signal to the main control unit 46.

The interruption flow is as follows. A zero-cross interruption flow shown in FIG. 6 will be described first. The interruption is accepted when the processing which terminates at the step S6 is completed. First, whether or not a lamp ON command from the main control unit 46 is present is determined (S27) and, if the answer of the step S27 is YES, lamp phase angle timer data TIME is set on a phase angle timer and the timer is started. This is followed by a step S29 for determining whether the heater 14 has been turned on or not. Specifically, a duty counter FUCNT is loaded with the previously obtained duty FUCYC and then checked. If the duty counter FUCNT is not zero, the heater trigger is turned on (S30) while the counter FUCNT is decremented. If the counter FUCNT is zero, the heater trigger is turned off (S31). Finally, a heater temperature AN1 is read via the terminal AN0 and stored.

Although not shown in a flowchart, a control period counter HETCNT is loaded with "100" when the power source frequency is 50 hertz and with "120" when it is 60 hertz, by the heater control subroutine (S10) shown in FIG. 4. In response to each of the interruptions, the counter HETCNT is decremented. It is when the counter HETCNT becomes zero that the duty updating timing is reached.

In summary, it will be seen that the present invention provides a method which frees the surface temperature of a fixing roller from unusual rises and falls ascribable to the inaccurate detection of surface temperatures which in turn is ascribable to a failure of a thermistor itself, which senses the surface temperatures, or an inaccurate position of the thermistor relative to the roller. This successfully eliminates incomplete image fixing and damage to equipment. In addition, the method prevents a paper sheet from curling or from jamming a paper transport path due to temperature elevation.

Various modifications will become possible for those skilled in the art after receiving the teachings of the present disclosure without departing from the scope thereof.

What is claimed is:

1. A method of controlling surface temperature of a fixing roller of a heat roller type image fixing device such that the surface temperature remains in a predetermined range, said fixing roller having a heater thereinside, said method comprising the steps of:

(a) preparing temperature sensing means held in contact with a surface of the fixing roller for sensing the surface temperature of said fixing roller;

(b) sensing the surface temperature by the temperature sensing means;

(c) if the temperature sensed by the temperature sensing means when a power source is turned on is lower than a predetermined temperature, sensing the surface temperature again by said temperature sensing means when a predetermined period of time expires after said power source has been turned on;

(d) detecting an effective value of a power source voltage when the power source is turned on;

(e) determining a period of time theoretically necessary to reach a predetermined upper limit of temperature deviation based upon the detected power source voltage;

(f) comparing an amount of temperature elevation occurred during an interval between the turn-on of the power supply and the expiration of the determined period of time with an upper limit and a lower limit of temperature elevation of said interval; and (g) when the amount of temperature elevation does not lie between the upper limit and the lower limit which are stored beforehand, determining that the surface temperature is not normal and inhibiting the heater installed in the fixing roller from being driven.

2. A method as claimed in claim 1, wherein step (f) comprises (r) storing the upper limit and the lower limit in a memory beforehand.

3. A method as claimed in claim 1, wherein the temperature sensing means comprises a thermistor.

* * * * *